US012624860B2

(12) United States Patent
Hutchison et al.

(10) Patent No.: US 12,624,860 B2
(45) Date of Patent: May 12, 2026

(54) INTEGRATED LIFTING HANDLE FOR A WATER HEATER APPLIANCE

(71) Applicant: Haier US Appliance Solutions, Inc., Wilmington, DE (US)

(72) Inventors: Gregory Hutchison, Shelbyville, KY (US); Norman Boulard, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 335 days.

(21) Appl. No.: 18/355,142

(22) Filed: Jul. 19, 2023

(65) Prior Publication Data

US 2025/0027680 A1 Jan. 23, 2025

(51) Int. Cl.

| | |
|---|---|
| ***F24H 9/02*** | (2006.01) |
| ***F24H 1/06*** | (2022.01) |
| ***F24H 1/18*** | (2022.01) |
| ***F24H 4/04*** | (2006.01) |
| ***F24H 9/00*** | (2022.01) |
| ***F24H 9/06*** | (2006.01) |

(52) U.S. Cl.

CPC ..... *F24H 9/02* (2013.01); *F24H 1/181* (2013.01); *F24H 4/04* (2013.01); *F24H 9/0005* (2013.01); *F24H 9/0094* (2013.01); *F24H 9/06* (2013.01); *F24H 1/06* (2013.01)

(58) Field of Classification Search

CPC ... F24H 9/02; F24H 1/181; F24H 4/04; F24H 9/0005; F24H 9/0094; F24H 9/06; F24H 1/06

See application file for complete search history.

(56) References Cited

FOREIGN PATENT DOCUMENTS

| | | | | | |
|---|---|---|---|---|---|
| CN | 206787030 | U | | 12/2017 | |
| CN | 111964266 | A | * | 11/2020 | ..... F24H 9/0005 |
| JP | 2010156509 | A | * | 7/2010 | |
| JP | 5247423 | B2 | | 7/2013 | |
| JP | 2016050701 | A | * | 4/2016 | |
| JP | 6223303 | B2 | | 11/2017 | |
| WO | WO-2024252884 | A1 | * | 12/2024 | ..... F24H 1/202 |

OTHER PUBLICATIONS

CN-111964266-A translation (Year: 2025).*
JP-2010156509-A translation (Year: 2025).*
JP-2016050701-A translation (Year: 2025).*

* cited by examiner

*Primary Examiner* — Michael G Hoang
*Assistant Examiner* — Kurt J Wolford
(74) *Attorney, Agent, or Firm* — Dority & Manning, P.A.

(57) ABSTRACT

A shroud for a water heater appliance may define a vertical direction, a lateral direction, and a circumferential direction. The shroud may include a front cover and a rear cover. The front cover and the rear cover may be coupled together to form the shroud. The rear cover may include a first handle that may be formed integrally into the rear cover. The rear cover may also include a second handle that may be formed integrally into the rear cover. The first handle and the second handle may each be spaced apart approximately along a circumference of the shroud.

10 Claims, 6 Drawing Sheets

INTEGRATED LIFTING HANDLE FOR A WATER HEATER APPLIANCE

FIELD

The present subject matter relates generally to a water heater appliance, and more particularly to integrated lifting handles for a water heater appliance.

BACKGROUND

Many households and buildings include water heaters (or hot water tanks) that selectively provide heated water on demand via faucets, showers, and the like. Conventional water heaters include a tank storing a quantity of water, a temperature sensor to sense the temperature of the water, one or more heat sources to provide heat to the water; and piping or tubing to deliver water to and from the tank.

Certain drawbacks exist that are related to the serviceability of current water heater appliances. For instance, the relatively large size and shape of water heater appliances make it difficult for an operator to move the water heater appliance. For example, the large size and shape of the water heater appliance may make it difficult for an operator of the water heater appliance to handle components of the water heater appliance during assembly, may make it difficult to sit the water heater appliance down into a horizontal position, for example, for transport of the water heater appliance, and/or may make it difficult to raise the water heater appliance to a vertical position, for example, during installation of the water heater appliance.

Accordingly, a water heater appliance that obviates one or more of the above-mentioned drawbacks would be beneficial. Particularly, a water heater appliance that includes integrated lifting handles would be useful.

BRIEF DESCRIPTION

Aspects and advantages of the invention will be set forth in part in the following description, or may be apparent from the description, or may be learned through practice of the invention.

In one exemplary embodiment, a water heater appliance is provided. The water heater appliance may define a vertical direction, a lateral direction, and a transverse direction. The water heater appliance may include a casing. The water heater appliance may also include a tank disposed within the casing. The tank may include a top portion and a bottom portion spaced apart approximately along the vertical direction. The water heater appliance may further include a first handle that may be formed integrally into the casing. The water heater appliance may also include a second handle that may be formed integrally into the casing. The first handle and the second handle may be spaced apart approximately along a circumference of the casing.

In another exemplary embodiment, a shroud for a water heater appliance is provided. The shroud may define a vertical direction, a lateral direction, and a transverse direction. The shroud may include a front cover and a rear cover that may be coupled together to form the shroud. The rear cover may include a first handle that may be formed integrally into the rear cover. The rear cover may also include a second handle that may be formed integrally into the rear cover. The first handle and the second handle may be spaced apart approximately along a circumference of the shroud.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
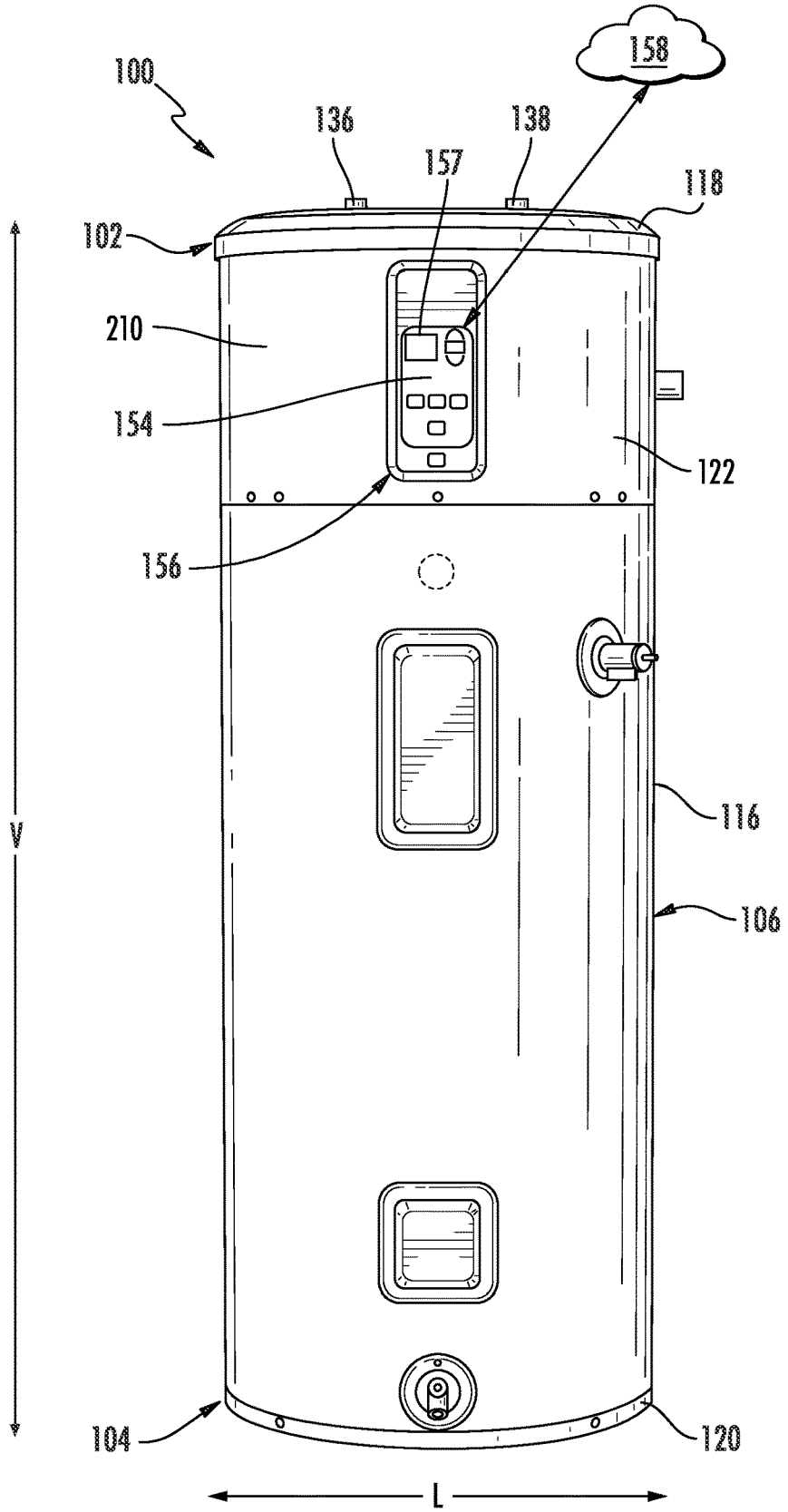
FIG. 1 provides a front elevation view of a water heater appliance according to one or more exemplary embodiments of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both").

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a ten percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise, or counterclockwise, with the vertical direction V.

FIG. 1 provides a front elevation view of a water heater appliance 100 according to one or more exemplary embodiments of the present disclosure. The water heater appliance 100 may define defines a vertical direction V, a lateral direction L, and a transverse direction T, see, for example, FIGS. 4 and 5. In some embodiments, the water heater appliance 100 may extend between a top portion 102 and a bottom portion 104 approximately along the vertical direction V. The water heater appliance 100 may include an outer shell or casing 106. The casing 106 may generally surround a tank 108, see, for example, FIG. 2, such that the tank 108 is disposed within the casing 106. The tank 108 may include a top portion 110 and a bottom portion 112 spaced apart from one another approximately along the vertical direction V. In addition, the tank 108 may define an interior volume 114 extending between the top portion 110 and the bottom portion 112 along the vertical direction V.

Figure 2:
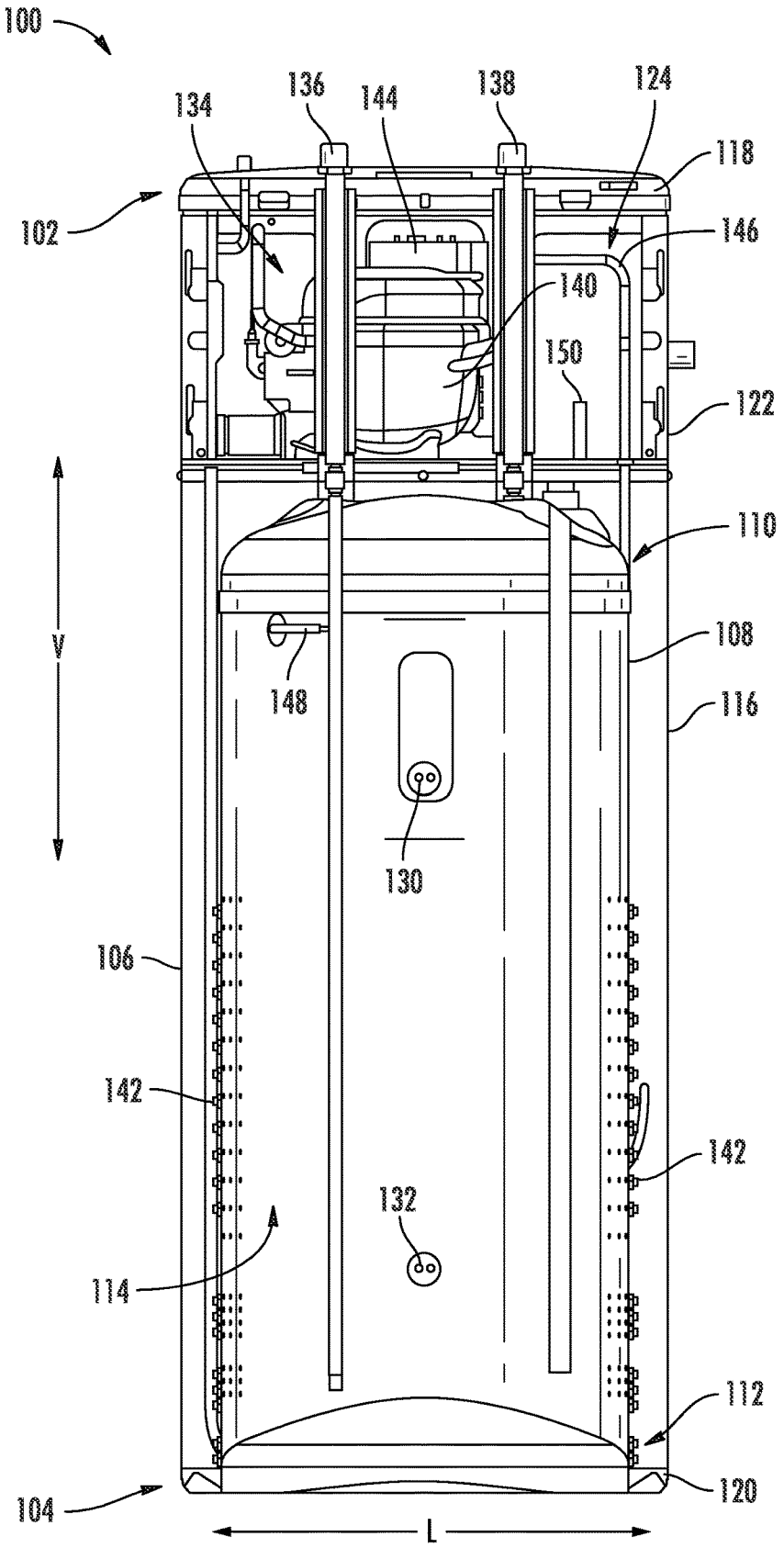
FIG. 2 provides a front section view of the exemplary water heater appliance of FIG. 1.
Figure 4:
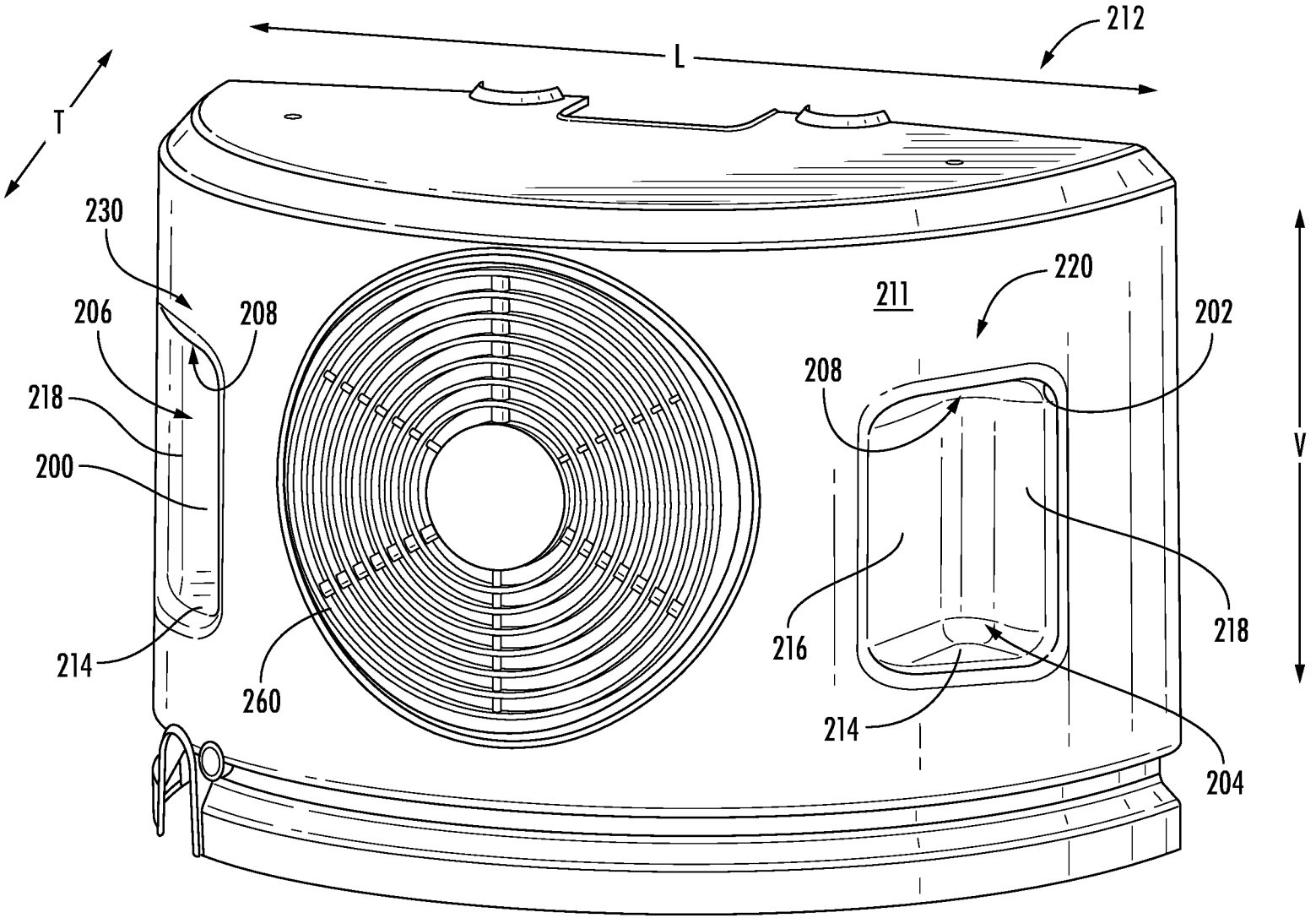
FIG. 4 provides a perspective view of a rear cover according to one or more exemplary embodiments of the present subject matter.
Figure 5:
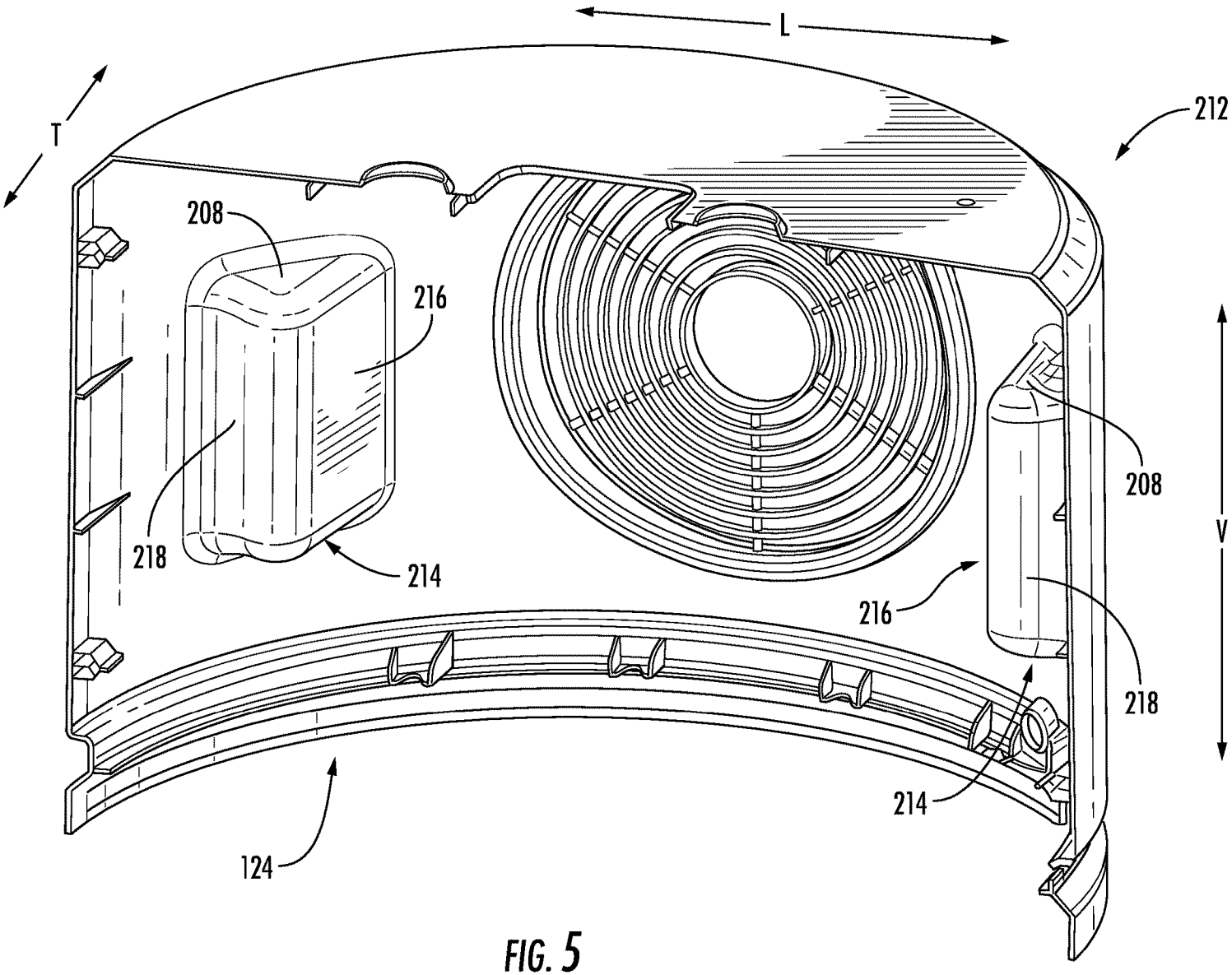
FIG. 5 provides an additional perspective view of a rear cover according to one or more exemplary embodiments of the present subject matter.

The casing 106 may be formed from a variety of components. For example, as illustrated in FIGS. 1 and 2, the casing 106 may include a wrapper 116, a shroud 122, and one or more covers, such as a top cover 118 that may be attached to the shroud 122 and a bottom cover 120. The shroud 122 may be positioned at the top portion 110 of the tank 108 approximately along the vertical direction V such that the shroud 122 may define a chamber 124, see, for example, FIG. 2, positioned over the tank 108 approximately along the vertical direction V. In some embodiments, the chamber 124 may serve as a machinery compartment for housing various operating components of the water heater appliance 100. Additionally, the shroud 122 may define a one or more vents 125 or apertures, for example, fan grill 260 as illustrated in FIGS. 4 and 5, that may extend through the shroud 122 from or to the chamber 124 of the shroud 122.

In some embodiments, the water heater appliance 100 may include an upper heating element 130 and a lower heating element 132, see, for example, FIG. 2 and a sealed system 134, see for example, FIG. 2, that may also be positioned within the casing 106 for heating water within the tank 108. The upper heating element 130 and the lower heating element 132 may be any suitable heating elements. For example, the upper heating element 130 and/or lower heating element 132 may be an electric resistance element, a microwave element, an induction element, or any other suitable heating element or combination thereof. The lower heating element 132 may also be a gas burner. As should be understood by those skilled in the art and as used herein, the term "water" includes purified water and solutions or mixtures containing water and, e.g., elements (such as calcium, chlorine, and fluorine), salts, bacteria, nitrates, organics, and other chemical compounds or substances.

The water heater appliance 100 may also include an inlet or cold water conduit 136 and an outlet or hot water conduit 138 that both may be in fluid communication with a chamber or interior volume 114, see, for example, FIG. 2, defined by the tank 108. As an example, cold water from a water source, e.g., a municipal water supply or a well, can enter the water heater appliance 100 through the cold water conduit 136. From the cold water conduit 136, such cold water can enter the interior volume 114 of the tank 108 wherein the water is heated with upper heating element 130, lower heating element 132, and/or sealed system 134 to generate heated water. Such heated water can exit the water heater appliance 100 at the hot water conduit 138 and, e.g., may be supplied to a bath, shower, sink, or any other suitable feature.

As mentioned above, the water heater appliance 100 may extend between the top portion 102 and the bottom portion 104 approximately along the vertical direction V. Thus, the water heater appliance 100 may generally be vertically oriented. The water heater appliance 100 may be leveled, e.g., such that the casing 106 is plumb in the vertical direction V, in order to facilitate proper operation of the water heater appliance 100. It should be understood that the exemplary water heater appliance 100 is provided by way of example only and that the present subject matter may be used with any suitable water heater appliance, including for example any heat pump water heater appliance.

FIG. 2 provides a front section view of the water heater appliance 100. As may be seen in FIG. 2, the water heater appliance 100 may include the sealed system 134 for heating water within the interior volume 114 of the tank 108. The sealed system 134 may generally operate in a heat pump cycle. Thus, the water heater appliance 100 may commonly referred to as a "heat pump water heater appliance." The water heater appliance 100 may additionally include one or more auxiliary heating elements, such as the upper heating element 130 and/or the lower heating element 132.

The sealed system 134 may include a compressor 140, a condenser 142 and an evaporator 144. The compressor 140 and/or evaporator 144 of the sealed system 134 may be disposed within the casing 106 at the top portion 102 of the water heater appliance 100, e.g., within the chamber 124 that may be defined by the shroud 122. As is generally understood, various conduits may be utilized to flow refrigerant between the various components of the sealed system 134. Thus, e.g., the evaporator 144 may be between and in fluid communication with the condenser 142 and the compressor 140. During operation of the sealed system 134, refrigerant may flow from the evaporator 144 through the compressor 140. For example, refrigerant may exit the evaporator 144 as a fluid in the form of a superheated vapor and/or high quality vapor mixture. Upon exiting the evaporator 144, the refrigerant may enter the compressor 140. The compressor 140 may be operable to compress the refrigerant. Accordingly, the pressure and temperature of the refrigerant may be increased in the compressor 140 such that the refrigerant becomes a superheated vapor.

The condenser 142 may be assembled in a heat exchange relationship with the tank 108 in order to heat water within the interior volume 114 of the tank 108 during operation of the sealed system 134. In particular, the condenser 142 may be positioned downstream of and in fluid communication with the compressor 140 and may be operable to heat the water within the interior volume 114 using energy from the refrigerant. For example, the superheated vapor from the compressor 140 may enter the condenser 142 wherein it transfers energy to the water within the tank 108 and condenses into a saturated liquid and/or liquid vapor mixture.

The sealed system 134 may also include a throttling device 146 between the condenser 142 and the evaporator 144. Refrigerant, which may be in the form of high quality/saturated liquid vapor mixture, may exit the condenser 142 and travel through the throttling device 146 before flowing through the evaporator 144. The throttling device 146 may generally expand the refrigerant, lowering the pressure and temperature thereof. The refrigerant may then be flowed through the evaporator 144.

The throttling device 146 may be any suitable components for generally expanding the refrigerant. For example, in some exemplary embodiments, the throttling device 146 may be a Joule-Thomson expansion valve, also known as a "J-T valve." In other exemplary embodiments, throttling device 146 may be an ejector. In still other exemplary embodiments, an electronic expansion valve, a capillary tube, a fixed orifice, or any other suitable apparatus may be utilized as throttling device 146.

The water heater appliance 100 may additionally include a tank temperature sensor 148. The tank temperature sensor 148 may be configured for measuring a temperature of water within the interior volume 114 of the tank 108. The tank temperature sensor 148 may be positioned at any suitable location within the water heater appliance 100. For example, the tank temperature sensor 148 may be positioned within the interior volume 114 of the tank 108 or may be mounted to the tank 108 outside of the interior volume 114 of the tank 108. The tank temperature sensor 148 may further be positioned within an upper portion of the tank 108. Alternatively, the tank temperature sensor 148 may be positioned within a lower portion of the tank 108. When mounted to the tank 108 outside of the interior volume 114 of the tank 108, the tank temperature sensor 148 can be configured for indirectly measuring the temperature of water within the interior volume 114 of the tank 108. For example, the tank temperature sensor 148 may measure the temperature of the tank 108 and correlate the temperature of the tank 108 to the temperature of water within the interior volume 114 of the tank 108. The tank temperature sensor 148 may be any suitable temperature sensor. For example, the tank temperature sensor 148 may be a thermocouple, a thermistor, or a resistance temperature detector.

In addition, water heater appliance 100 may additionally include an air temperature sensor 150. The air temperature sensor 150 may be configured for measuring a temperature of ambient air within the environment in which water heater appliance 100 is located. The air temperature sensor 150 can be positioned at any suitable location within or around water heater appliance 100. For example, the air temperature sensor 150 may be positioned at an inlet of evaporator 144, within chamber 124, or outside casing 106. The air temperature sensor 150 may be any suitable temperature sensor. For example, the air temperature sensor 150 may be a thermocouple, a thermistor, or a resistance temperature detector.

The water heater appliance 100 may further include a controller 154 that regulates operation of the water heater appliance 100. The controller 154 may be, for example, in operative communication with sealed system 134 (such as compressor 140, and/or other components thereof), auxiliary heating elements, for example, upper heating element 130 and lower heating element 132, and/or tank temperature sensor 148. Thus, the controller 154 can selectively activate the sealed system 134 and/or auxiliary heating element, for example, upper heating element 130 and lower heating element 132, in order to heat water within interior volume 114 of tank 108.

The controller 154 includes memory and one or more processing devices such as microprocessors, CPUs or the like, such as general or special purpose microprocessors operable to execute programming instructions or micro-control code associated with operation of water heater appliance 100. The memory can represent random access memory such as DRAM, or read only memory such as ROM or FLASH. The processor executes programming instructions stored in the memory. The memory can be a separate component from the processor or can be included onboard within the processor. Alternatively, the controller 154 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 154 may further include a user interface panel 156 through which a user may select various operational features and modes and monitor the operation of water heater appliance 100. In one embodiment, the user interface panel 156 may represent a general purpose I/O ("GPIO") device or functional block. In one embodiment, the user interface panel 156 may include input components, such as one or more of a variety of electrical, mechanical or electro-mechanical input devices including rotary dials, push buttons, and touch pads. The user interface panel 156 may include a display component, such as a digital or analog display device 157 designed to provide operational feedback to a user. The user interface panel 156 may be in communication with the controller 154 via one or more signal lines or shared communication busses.

Water heater appliance 100 may further be communicatively coupled to a network 158 for sending and/or receiving information. Network 158 can be any type of communication network. For example, network 158 can include one or more of a wireless network, a wired network, a personal area network, a local area network, a wide area network, the internet, etc. Controller 154 may be used to establish communications with network 158. In this regard, for example, controller 154 may include a communications module to facilitate communications between controller 154 and network 158. For instance, the communications module of controller 154 may serve as an interface to permit water heater appliance 100 to transmit a service request, a notification of a condition to a user, diagnostic information, or to receive information, like a command to adjust an operating parameter of water heater appliance 100.

In some instances, the water heater appliance 100 or components thereof, for example, the shroud 122, may be required to be moved and/or lifted. In this regard, the exemplary water heater appliance 100 may include features that may assist, for example, an operator of the water heater appliance 100, to move and/or lift the water heater appliance 100. For example, an operator of the water heater appliance 100 may be required to move the water heater appliance 100 during assembly, transportation, installation, and servicing of the water heater appliance. For example, during assembly of the water heater appliance 100, an operator may be required to lift the shroud 122 to the top portion 110 of the tank 108 such that it may be positioned at the top portion 110 of the tank 108. As another example, before and/or after transportation of the water heater appliance 100, an operator may be required to lift the water heater appliance 100 from a horizontal orientation, for example, the orientation that the water heater appliance 100 may be stored and transported in, to the vertical orientation. As yet another example, during installation and servicing of the water heater appliance 100, an operator of the water heater appliance 100 may be required to move and/or lift the water heater appliance 100 to its operating location, for example, the space at which the water heater appliance 100 may be located at during operation.

In some instances, due to the size of the water heater appliance 100 and its various components, moving the water heater appliance 100 may be a cumbersome and laborious task for an operator as the water heater appliance 100 may be relatively large and heavy. In this regard, in some embodiments, the water heater appliance 100 may include integrated lifting features, for example, a hand hold or handles described in more detail below, that may be molded into the casing 106, such as in the shroud 122 portion of the casing 106 and/or in the wrapper 116 portion of the casing 106. In some embodiments, the handles may be configured to optimize the grip for an operator that may be handling the water heater appliance 100, for example, during assembly, transportation, installation, and/or servicing of the water heater appliance 100.

In some embodiments, large continuous cylindrical surfaces of the casing 106, and more particularly the shroud 122, may include a vertical column strength. The vertical column strength of the casing 106 may generally refer to the large continuous cylindrical surfaces ability to resist buckling or collapse under a load, for example, a compressive load that may be applied to the casing 106 when the water heater appliance 100 may be in the vertical orientation, for instance, due to the force of gravity. In some embodiments, the handles may be configured to provide rigidity and stiffness to the components, for example, the casing 106, of the water heater appliance 100 into which the handles may be integrated. For example, the handles may be positioned such that they may break up portions of the large continuous cylindrical surfaces of the casing 106 and may increase the vertical column strength of the casing 106.

Figure 3:
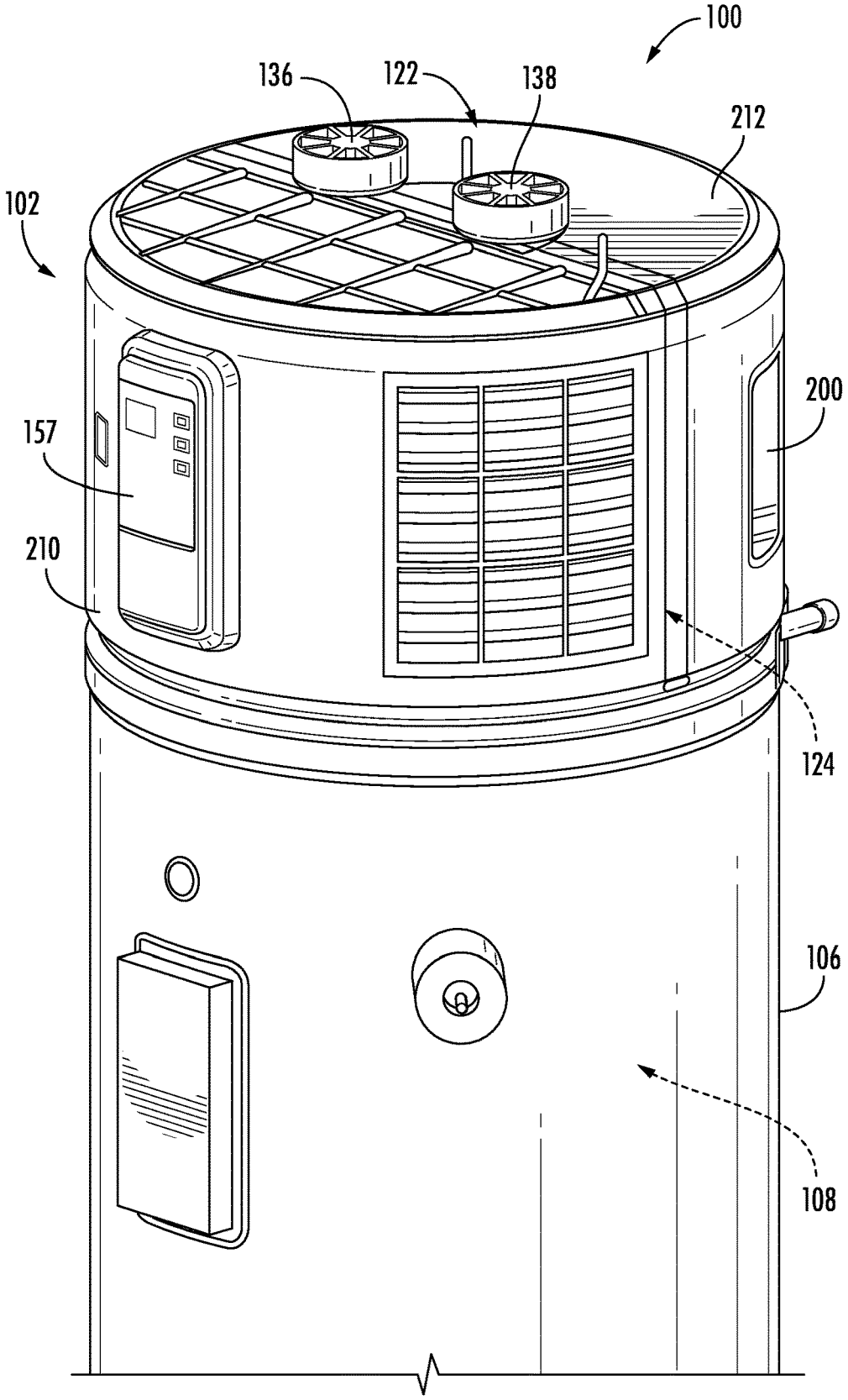
FIG. 3 provides a close-up perspective view of the exemplary water heater appliance of FIG. 1.

Referring now to FIGS. 3 through 5, additional views of the water heater appliance 100 and components thereof, for example, the shroud 122, according to one or more exemplary aspects of the present subject matter are provided. Specifically, FIG. 3 illustrates a close-up perspective view of the water heater appliance 100 and FIGS. 4 and 5 each illustrate perspective views of a rear cover 212 of the shroud 122. As described in more detail above, the water heater appliance 100 may include the tank 108 disposed within the casing 106. In some embodiments, the water heater appliance 100 may include a first handle 200 and a second handle 202, see, for example, FIGS. 4 and 5. The first handle 200 and the second handle 202 each may be formed integrally into the casing 106. Furthermore, the first handle 200 and the second handle 202 may be spaced apart approximately along a circumference of the casing 106.

As described in more detail above, in some embodiments, the casing 106 may include the shroud 122 positioned at the top portion 102 of the tank 108. For instance, the shroud 122 may be positioned at the top portion 102 such that the chamber 124 may serve as a machinery compartment for operation components of the water heater appliance 100. In such embodiments, the first handle 200 and the second handle 202 may each be formed integrally into the shroud 122 and spaced apart around the circumference of the shroud 122 to provide a convenient handling point, for example, for an operator of the water heater appliance 100, to lift or move the shroud 122 relative to the tank 108.

In some embodiments, the shroud 122 may be a relatively large body that may typically be formed from metal materials, such as sheet metal. In some embodiments, the first handle 200 may provide a first non-continuous portion 220 of the shroud 122 and the second handle 202 may provide a second non-continuous portion 230 of the shroud 122, whereby the shroud 122 may be stiffened by the first non-continuous portion 220 and the second non-continuous portion 230, respectively. Particularly, the first handle 200 and the second handle 202 may each break up the surface of the shroud 122, for example, may provide variance in an outer surface 211 of the shroud 122 such that the vertical strength of the shroud 122 may be increased. In this regard, the stiffness and rigidity of the shroud 122 may also be increased.

In addition, in some embodiments, the shroud 122 may include a front cover 210 and a rear cover 212 that may be coupled together to form the shroud 122. In some embodiments, for example, FIGS. 4 and 5, the first handle 200 and the second handle 202 may each be formed integrally into the rear cover 212. Additionally, in some embodiments, the first handle 200 may define a first recess 204 that may be extended into the casing 106, such as extended into the chamber 124 that may be defined by the shroud 122. For instance, the first recess 204 may be extended into the casing 106 generally along the lateral direction L and transverse direction T. The second handle 202 may define a second recess 206 that may be extended into the casing 106, such as into the chamber 124 defined by the shroud 122 of the casing 106. For instance, the second recess 206 may be extended into the casing 106 generally along the lateral direction L and the transverse direction T.

In some embodiments, the first handle 200 and the second handle 202 may each include a top surface 208, a bottom surface 214, a flat surface 216, and a rounded surface 218. The top surface 208 and the bottom surface 214 of each of the first handle 200 and the second handle 202 may be extended into the chamber 124 defined by the shroud 122 of the casing 106 approximately along the lateral direction L and approximately along the transverse direction T such that the top surface 208 and the bottom surface 214 of each of the first handle 200 and the second handle 202 may be approximately on a lateral-transverse plane of the shroud 122.

In some embodiments, the flat surface 216 of each of the first handle 200 and the second handle 202 may be extended from the respective bottom surface 214 to the respective top surface 208 approximately along the vertical direction V and may be extended approximately along the transverse direction such that the flat surface 216 for each of the first handle 200 and the second handle 202 may be approximately on a vertical-transverse plane of the shroud 122.

Figure 6:
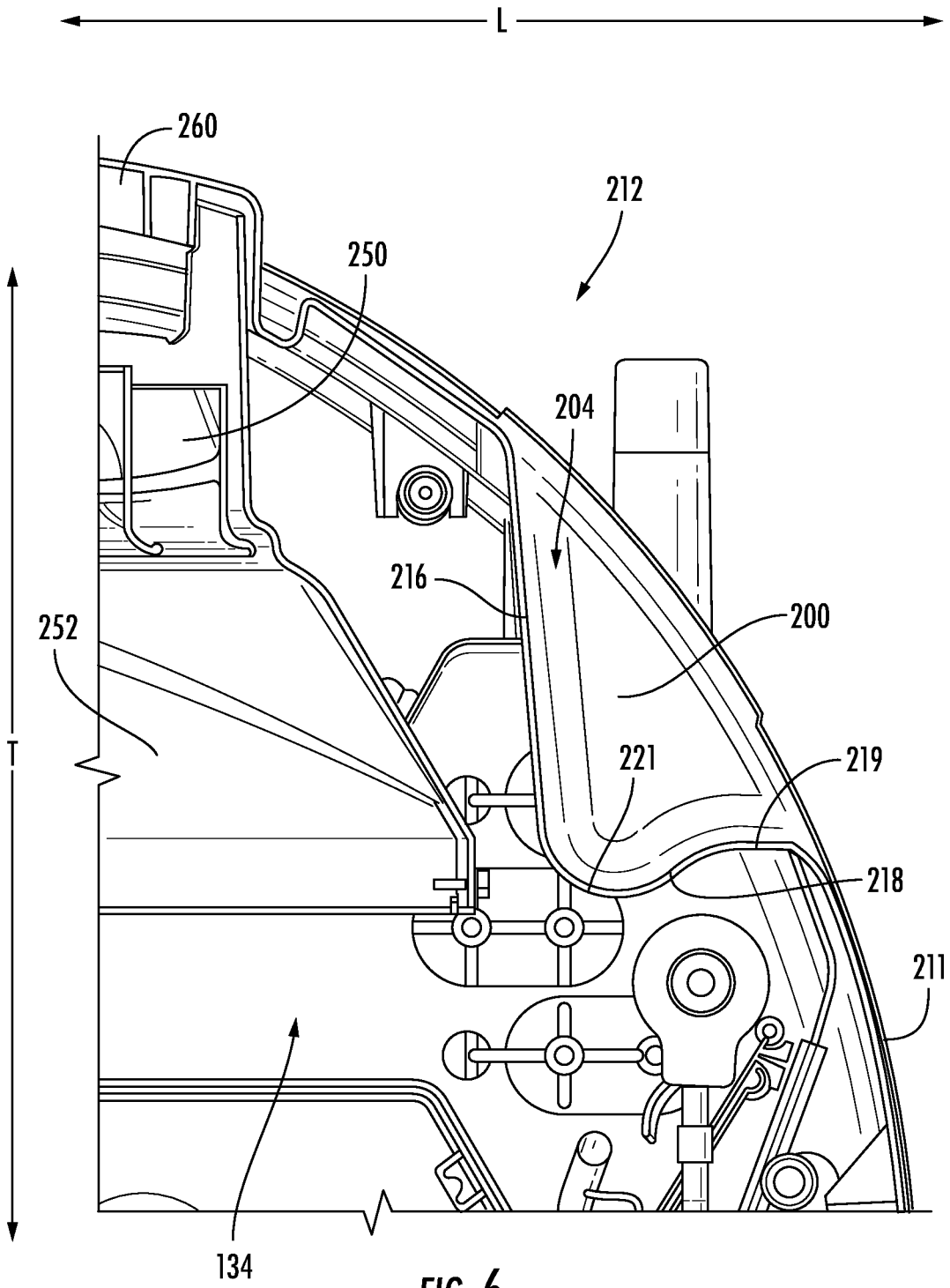
FIG. 6 provides a close-up sectional view of the water heater appliance of FIG. 1 according to one or more exemplary embodiments of the present subject matter.

Referring now to FIG. 6, a close-up cross sectional view of the rear cover 212 of the shroud 122 according to one or more exemplary aspects of the present subject matter is provided. As mentioned above, in some embodiments, the water heater appliance 100 may include a sealed system 134 that may be configured to generate heated water. In some embodiments, the sealed system 134 may include a fan 250 that may be surrounded by a fan shroud 252, for instance, to direct a flow of air that may be created by the fan 250 through the sealed system 134. In some embodiments, the rear cover 212 may include a fan grille 260 in flow communication with the fan 250.

As illustrated in FIG. 6, the first handle 200 may be positioned outward of the sealed system 134 approximately along the lateral direction L. One of ordinary skill in the art would understand that only the first handle 200 positioned outward of the sealed system 134 approximately along the lateral direction L is illustrated in FIG. 6 for the sake of clarity and brevity. It is understood that the second handle 202 may mirror the size shape and positioning of the first handle 200. For example, the second handle 202 may be positioned outward of the sealed system approximately along the lateral direction L.

In some embodiments, the rounded surface 218 of the first handle 200 may be configured to be the main hand hold surface of the first handle 200. For instance, the rounded surface 218 may be configured to be an ergonomically shaped surface that may accommodate a hand of an operator of the water heater appliance 100, such as when the water heater appliance 100 may be moved and/or lifted. Particularly, in some embodiments, the rounded surface 218 may include a concave portion 219 and a convex portion 221. The concave portion 219 may extend from the outer surface 211 of the rear cover 212 to the convex portion 221. The radius of curvature of the concave portion 219 may be configured such that the palm of an operator's hand may wrap around the concave surface 219. Additionally, the opposing radius of curvature of the convex portion 221 may be configured such that the fingers of an operator's hand may be positioned in the convex portion 221 such that a grip may be formed within the first handle 200.

As explained herein, aspects of the present subject matter are generally directed to a water heater appliance that includes integrated lifting handles for moving and/or lifting the water heater appliance during assembly, transportation, installation, and servicing of the water heater appliance. Moreover, as explained herein the handles may be integrated into the metal shroud or tank insulation cover of the water heater appliance. The handles may be integrated into one or both halves of the shroud, for example, in the rear shroud, to advantageously provide convenient handling and grip of the shroud during assembly, transportation, installation, and servicing of the water heater appliance. Furthermore, the handles may advantageously increase the vertical strength of the shroud by adding rigidity and stiffness to the shroud.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A water heater appliance defining a vertical direction, a lateral direction, and a transverse direction, the water heater appliance comprising:

a casing, the casing comprising a shroud defining a chamber;

a tank disposed within the casing, the tank comprising a top portion and a bottom portion spaced apart approximately along the vertical direction, wherein the shroud is positioned at the top portion of the tank;

a first handle formed integrally into the shroud, the first handle comprising a top surface, a bottom surface, a flat surface, and a rounded surface, wherein the top surface and the bottom surface of the first handle are each extended into the casing approximately along the lateral direction and wherein the flat surface and the rounded surface of the first handle are each extended from the bottom surface to the top surface approximately along the vertical direction; and a second handle formed integrally into the shroud, the second handle comprising a top surface, a bottom surface, a flat surface, and a rounded surface, wherein the top surface and the bottom surface of the second handle are each extended into the casing approximately along the lateral direction and wherein the flat surface and the rounded surface of the second handle are each extended from the bottom surface to the top surface approximately along the vertical direction; and wherein the first handle and the second handle are spaced apart approximately along a circumference of the shroud.

2. The water heater appliance of claim 1, wherein a first non-continuous portion of the shroud is provided by the first handle and a second non-continuous portion of the shroud is provided by the second handle, whereby the shroud is stiffened by the first non-continuous portion and the second non-continuous portion.

3. The water heater appliance of claim 1, wherein the shroud comprises a front cover and a rear cover and the front cover and the rear cover are coupled together to form the shroud.

4. The water heater appliance of claim 3, wherein the first handle and the second handle are each formed integrally into the rear cover.

5. The water heater appliance of claim 1, wherein the first handle defines a first recess extended into the shroud and the second handle defines a second recess extended into the shroud.

6. The water heater appliance of claim 1, further comprising a sealed system configured to generate heated water, wherein the first handle and the second handle are each positioned outward of the sealed system approximately along the lateral direction.

7. A shroud of a casing for a water heater appliance defining a vertical direction, a lateral direction, and a transverse direction, the water heater appliance comprising a tank disposed within the casing, the tank comprising a top portion and a bottom portion spaced apart along the vertical direction, the shroud comprising:

a front cover a rear cover; wherein the front cover and the rear cover are coupled together to form the shroud;

a first handle formed integrally into the rear cover, the first handle comprising a top surface, a bottom surface, a flat surface, and a rounded surface, wherein the top surface and the bottom surface of the first handle are each extended into the casing approximately along the lateral direction and wherein the flat surface and the rounded surface of the first handle are each extended from the bottom surface to the top surface approximately along the vertical direction; and a second handle formed integrally into the rear cover, the second handle comprising a top surface, a bottom surface, a flat surface, and a rounded surface, wherein the top surface and the bottom surface of the second handle are each extended into the casing approximately along the lateral direction and wherein the flat surface and the rounded surface of the second handle are each extended from the bottom surface to the top surface approximately along the vertical direction; and wherein the first handle and the second handle are spaced apart approximately along a circumference of the shroud.

8. The water heater appliance of claim 7, wherein the shroud defines a chamber, wherein the first handle defines a first recess extended into the chamber and the second handle defines a second recess extended into the chamber.

9. The water heater appliance of claim 7, wherein the rounded surface of the first handle comprises a first concave portion and a first convex portion, and wherein the rounded surface of the second handle comprises a second concave portion and a second convex portion.

10. The water heater appliance of claim 7, wherein a first non-continuous portion of the shroud cover is provided by the first handle, wherein a second non-continuous portion of the shroud cover is provided by the second handle, whereby the shroud cover is stiffened by the first non-continuous portion and the second non-continuous portion.

* * * * *